United States Patent [19]

Freeland et al.

[11] Patent Number: 4,699,116

[45] Date of Patent: Oct. 13, 1987

[54] MULTIPLE ARM TARGET LAUNCHER

[75] Inventors: John P. Freeland, 3200 Cranleigh Dr., Tallahassee, Fla. 32308; Patrick S. Mullins, Tallahassee, Fla.

[73] Assignee: John Paul Freeland, Tallahassee, Fla.

[21] Appl. No.: 819,710

[22] Filed: Jan. 17, 1986

[51] Int. Cl.[4] ..... F41B 3/04

[52] U.S. Cl. ..... 124/7; 124/32; 124/34; 124/36; 124/42

[58] Field of Search ..... 273/26 D; 124/7, 23 R, 124/23 A, 24 R, 36, 32, 6, 8, 9

[56] References Cited

U.S. PATENT DOCUMENTS

| | | | |
|---|---|---|---|
| 214,962 | 4/1879 | Smith | 124/7 |
| 722,132 | 3/1903 | McQueen | 124/36 |
| 2,080,958 | 5/1937 | Beasley et al. | 124/7 |
| 2,583,767 | 1/1952 | Daignas | 124/7 |
| 2,700,379 | 1/1955 | Brigati | 124/7 |
| 3,568,199 | 3/1971 | Hartness | 343/225 |
| 3,739,373 | 6/1973 | Liming | 340/309 |
| 3,770,981 | 1/1973 | Nelson | 307/154 |
| 3,923,033 | 12/1975 | Laporte et al. | 124/8 |
| 4,611,571 | 9/1986 | Tressler et al. | 124/7 |

*Primary Examiner*—Richard C. Pinkham
*Assistant Examiner*—T. Brown
*Attorney, Agent, or Firm*—Sixbey, Friedman & Leedom

[57] ABSTRACT

A target launcher having multiple throwing arms which are driven by an electronic control assembly to launch each throwing arm sequentially at a predetermined timed interval. The target launcher will accommodate a variety of different kinds of targets to provide the shooting enthusiast, in particular the archer, with an automatically controlled supply of moving targets. Each throwing arm is released from a lock position to impart a substantially vertical trajectory to one or more targets loaded therein. The timing of the release of each throwing arm is preset manually prior to actuation of the control assembly circuitry. Actuation of the control assembly selectively drives a solenoid associated with each throwing arm to effect the sequential release of each throwing arm in accordance with the timing selected. The control assembly is designed to drive only a single solenoid if the release of only a single throwing arm is desired or to be actuated to a multi-mode operational state to drive all of the solenoids and, hence, all of the throwing arms in sequence at the intervals selected. Dual audible signals of different frequencies are provided to signal first the actuation of the electronic control assembly and next the release of each throwing arm.

13 Claims, 6 Drawing Figures

MULTIPLE ARM TARGET LAUNCHER

TECHNICAL FIELD

The present invention relates generally to devices for launching targets for shooting during target practice and in particular to a multiple arm target launcher which may be automatically preset to launch sequentially at timed intervals a plurality of targets.

BACKGROUND ART

The sport of shooting currently enjoys widespread popularity and has become a highly competitive sport in which a shooter must be capable of sustaining a high level of skill and accuracy to prevail in competition. The sport of archery, in particular, has enjoyed an increase in popularity. Archery today, however, is no longer limited to the stationary types of targets commonly associated with the sport. Rather, contemporary archers shoot at flying targets, both in competition and in hunting. Skill and accuracy can only be developed by repeated practice shooting at the kinds of targets employed in shooting competitions. The kinds of shooting competitions which require the shooter to hit a moving target are particularly difficult to practice for unless the shooter has a contingent of other people to call on to throw targets for him or her to shoot at. The shooting enthusiast who wants to develop accuracy in hitting moving targets to increase his or her hunting skills also shares this problem.

Devices designed to launch automatically targets for shooting are available. However, these devices are directed almost universally to the sport of skeet or trap shooting and are exclusively for gun shooters rather than archers. In this sport, a disc-like clay "pigeon" target is launched, generally from a small building, along a trajectory which is essentially horizontal with respect to the ground. U.S. Pat. No. 3,923,033 to LaPorte et al discloses such a target-throwing device. The target-throwing device of this patent includes structure for automatically feeding a target to a single throwing arm, for releasing the arm to throw the target and for then returning the throwing arm to a cocked position ready to receive another target. The cycle is activated by a switch, which must be manually operated to start the cycle and release a target. There is no suggestion in this reference that the target thrower disclosed therein could be modified to obtain the automatic sequential release of a plurality of targets at controlled, predetermined intervals. Neither is there any suggestion that more than one throwing arm could be employed to release a plurality of targets. Moreover, the single arm type of target thrower disclosed in the LaPorte et al patent can throw only a single target unless provided with a separate gravity feed mechanism such as that shown therein and thus does not easily provide a shooter with the sustained supply of moving targets required to enhance shooting skill.

The prior art does disclose, in U.S. Pat. No. 3,739,373, an automatic target release system whereby a "clay pigeon" or similar target is released at a predetermined time interval following the provision of a signal to the shooter. The actuation of the system must be accomplished manually, preferably by the person designated scorekeeper in the shooting competition, each time a target is to be released. The target release system disclosed in this reference employs a timing system which is designed to provide a single signal and releases only a single target each time the system is manually activated. There is no teaching in this patent that the timer control disclosed therein could be employed to effect the automatic sequential release of a plurality of targets from more than one throwing arm at predetermined intervals.

Other devices for activating target release systems are disclosed in the prior art. Those disclosed in U.S. Pat. Nos. 3,568,199 and 3,770,981 are exemplary of remotely controlled systems designed to be used with skeet or trap shooting machines. However, neither of the systems described in these patents provides for the automatic, sequential release of a plurality of targets at predetermined intervals.

The target release devices disclosed by the prior art do not address an additional problem encountered by the shooting enthusiast who is not interested in trap or skeet shooting. The shooter who does not want to be limited either to shooting at skeet targets or to the rules and regulations of skeet shooting, but wants simply to go out in the fields and practice shooting at other types of targets moving along varied trajectories cannot use the kinds of target throwers disclosed by the prior art for this purpose. Aside from the great weight and bulk of the prior art target throwers, the complexity of these devices renders their use by the non-professional shooter both difficult and prohibitively expensive. Moreover, the available throwers are not only easily transported from one place to another, but are also not readily adjustable to vary the trajectory of flight path of the target. Finally, the prior art target throwers are designed exclusively to throw targets for shooters who use guns. These target throwers are essentially useless for archers who want to enhance their skill and accuracy shooting a moving target with a bow and arrow.

Consequently, the prior art has filed to disclose a target throwing device suitable for use by either archers or both gun and bow and arrow shooting enthusiasts which is sufficiently portable to permit it to be readily transported to a target shooting site. The prior art further fails to disclose a target throwing device having multiple throwing arms adaptable for throwing a variety of different targets including a control system which may be preset and controlled by the shooter to launch automatically a plurality of targets sequentially at predetermined intervals.

SUMMARY OF THE INVENTION

It is, therefore, an object of the present invention to provide a target launcher which overcomes the disadvantages of the prior art.

It is an additional object of the present invention to provide a target launcher including multiple controlled throwing arms adaptable to launch either sequentially or simultaneously a variety of different kinds of targets.

It is another object of the present invention to provide a multiple arm target launcher which may be readily transported to and from a target practice site and which may be easily loaded with targets and activated to launch a plurality of targets.

It is a further object of the present invention to provide a multiple arm target launcher which is capable of launching a plurality of targets along a trajectory which is substantially vertical with respect to the ground so that the greatest target surface area is presented to the shooter and which can be readily modified to launch targets along a trajectory which is substantially horizontal with respect to the ground.

It is yet another object of the present invention to provide a multiple arm target launcher including a control system which utilizes a single input to achieve multiple modes of operation.

It is still another object of the present invention to provide a multiple arm target launcher including a control system which automatically releases each throwing arm sequentially at a predetermined timed interval.

It is yet a further object of the present invention to provide a multiple arm target launcher including a control system which can be operated from a remote location by the target shooter.

It is still a further object of the present invention to provide a multiple arm target launcher including a control system which provides dual signals to indicate first activation of the control sustem and next the release of each throwing arm as it occurs.

In accordance with the aforesaid objects, a multiple arm target launcher is provided including a plurality of spring loaded throwing arms rotatably mounted in a frame to pivot between a lock position and a release position. Each throwing arm includes target receiving means configured to receive targets of different shapes and sizes positioned on a surface of the throwing arm oriented away from the ground so that when the throwing arm is released from its lock position, the target is thrown along a trajectory which is substantially vertical with respect to the ground and the largest face of the target is presented to the shooter. A solenoid-activated latch means is associated with each throwing arm to secure the arm in its lock position. A control system is additionally provided for the multiple-arm target launcher which can be activated manually to release a single throwing arm or automatically to release sequentially each of the throwing arms at a preset, timed interval. Additionally, dual signals are provided to alert the shooter, first that the launcher control system has been initially activated and then to signal the release of each throwing arm from its lock position. Remote control means are further provided to permit the shooter to activate the launcher control system from a location remote to the launcher.

Other objects and advantages of the present invention will be apparent from the following description, drawings and claims.

BEST MODE FOR CARRYING OUT THE INVENTION

The multiple arm target launcher of the present invention is ideally suited for providing shooting enthusiasts, in particular archers, with the kind of sustained target practice required to develop and enhance accuracy for shooting moving targets. One or more targets can be automatically launched at timed intervals along a vertical trajectory so that the face or largest surface of the target is presented to the shooter or archer. Moreover, the shooter or archer can preset the sequential timed interval at which the targets are released and can activate the target launcher from a shooting position remote from the launcher. The interval between target release can be selected to accommodate the requirements of both the novice and the experienced archer. Shooters, in addition, will be able to use the present invention to enhance either their hunting skills or their skeet shooting skills. The versatility of the present target launcher results from the combination of a unique structural design and a unique electronic control system which function synergistically to provide the shooting enthusiast with a wide variety of target practice opportunities.

Figures 1, 4:
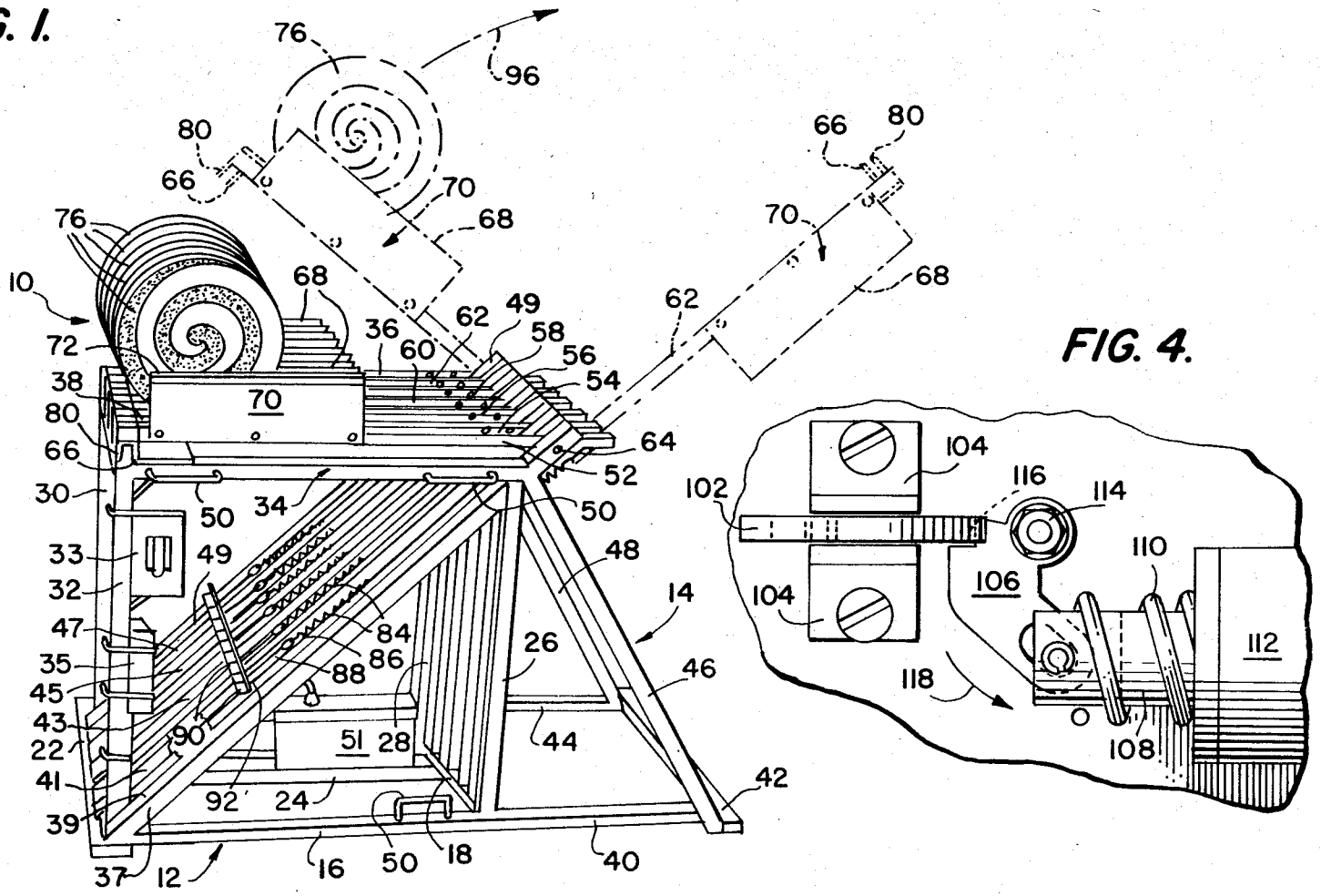
FIG. 1 is a side perspective view of a six-arm target launcher showing the throwing arms in three positions: all arms in the lock position; following release of the first throwing arm; and after the released throwing arm has reached the release position.
FIG. 4 is a top view of a latch and solenoid assembly constructed in accordance with the present invention.

Referring to the drawings, FIG. 1 illustrates the multiple arm target launcher of the present invention in side perspective view. The target launcher is described herein as having six or eight throwing arms; however, the present invention is intended to encompass any number of throwing arms from a single arm constructed and operated in accordance with the principles discussed herein to any number of arms which might be employed. The number of throwing arms provided is directly related to the portability of the launcher. A target launcher having six to eight throwing arms can be constructed in a size and weight which will easily fit in the back of some station wagons, four-wheel-drive vehicles, a pick-up truck or the like so that the shooter can readily transport the launcher to the target practice site with very little assistance. If, however, the target launcher is intended to remain in a single location, such as at a shooting range, these size and weight limitations are not critical, and the throwing arms provided could be increased to any number. The number of throwing arms provided in accordance with the present invention, therefore, is not intended to be limited to any specific number.

The multiple arm target launcher 10 shown in FIG. 1 includes a throwing arm support frame 12 and a frame brace 14. Although the preferred material for constructing the support frame 12 and frame brace 14 is steel tubing having a square cross-sectional configuration, any similar material which will provide comparable support and stability may be employed. The geometry of the throwing arm support frame 12 and frame brace 14 have been selected to enhance further the stability of the launcher when the throwing arms are released. Additional stability could also be achieved by providing anchor means which could include stakes, auger, anchors and the like to secure the frame to the ground.

The support frame 12 has a substantially cubic open configuration defined by base members, vertical side members perpendicular to the base members and top members parallel to the base members. At least four base members 16, 18, 20 and 22 positioned to defined the base of the cube are required to provide sufficient support and stability to the launcher. It is preferred to provide a stabilizing base member 22 located at the front of the launcher which has larger dimensions than the other base members and which extends beyond the perimeter of the rectangle defined by these base members. It may also be desirable to provide one or more additional base members, such as member 24 shown in FIG. 1, within the perimeter of the rectangular base to increase the stability of the launcher and to support components of the control system as will be explained hereinbelow. The need for such additional base members may increase as the number of throwing arms is increased. The frame 12 additionally includes vertical side members 26, 28, 30 and 32 which are substantially perpendicular to the base members and substantially parallel to each other to define the framework of the adjacent sides of the substantially cubic frame. Opposed parallel top members 34 and 36 which are substantially perpendicular to side members 26 and 32 and 28 and 30, respectively, and substantially parallel to the base members complete the frame 12. A shelf member 38 (FIG. 2), located in the same plane as the top members 34 and 36, provides some stability to the frame, but functions primarily to protect the throwing arm latch and solenoid assembly as described below.

To provide support structure required for each throwing arm as well as to increase the stability of the launcher, a plurality of parallel throwing arm supports 37, 39, 41, 43, 45, 47 and 49 are positioned to form integral components of the frame 12 and frame brace 14. The throwing arm supports, which are preferably constructed of the same material as the frame and frame brace, extend diagonally from frame stabilizing base member 22 to a point just beyond the intersection of the frame top members 34 and 36 with the frame brace side members 46 and 48, respectively. Since a throwing arm will be positioned between two supports as explained hereinbelow, there will be one more throwing arm support than throwing arm.

The frame brace 14 provides a degree of stability and shock-absorbing capacity that could not be provided by the frame 12 alone and is constructed integrally with the frame. The frame brace 14 preferably has the substantially triangular configuration shown in FIG. 1, although other geometric configurations which perform the same function are contemplated to be within the scope of the present invention. The frame brace includes base members 40, 42, 44 and member 18, which it shares in common with the frame 12, located so that the frame brace base members are coplanar with the frame base members to define a rectangle. Frame brace base member 40 is substantially coextensive with frame base member 16, and frame brace base member 44 is substantially coextensive with frame base member 20. Frame brace stabilizing base member 42, which is substantially parallel to frame stabilizing base member 22, also extends beyond the perimeter of the rectangle defined by the frame brace base members to increase the stability of the launcher. Angular side support members 46 and 48 of the frame brace extend from brace stabilizing base member 42 to intersect with frame vertical side members 26 and 28 and frame top members 34 and 36, respectively.

Figure 5:
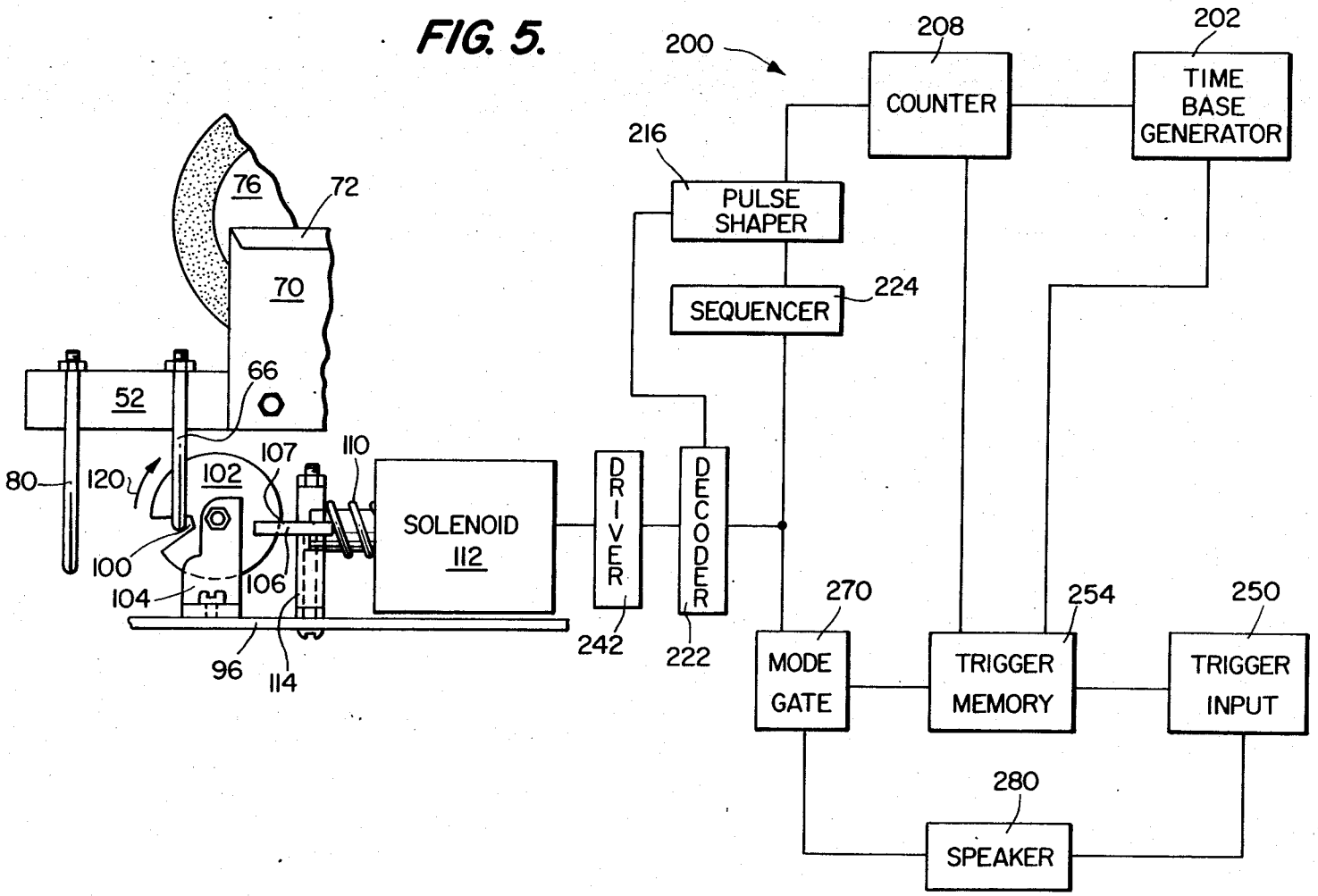
FIG. 5 is a block diagram of the throwing arm control system of the present invention.
Figure 6:
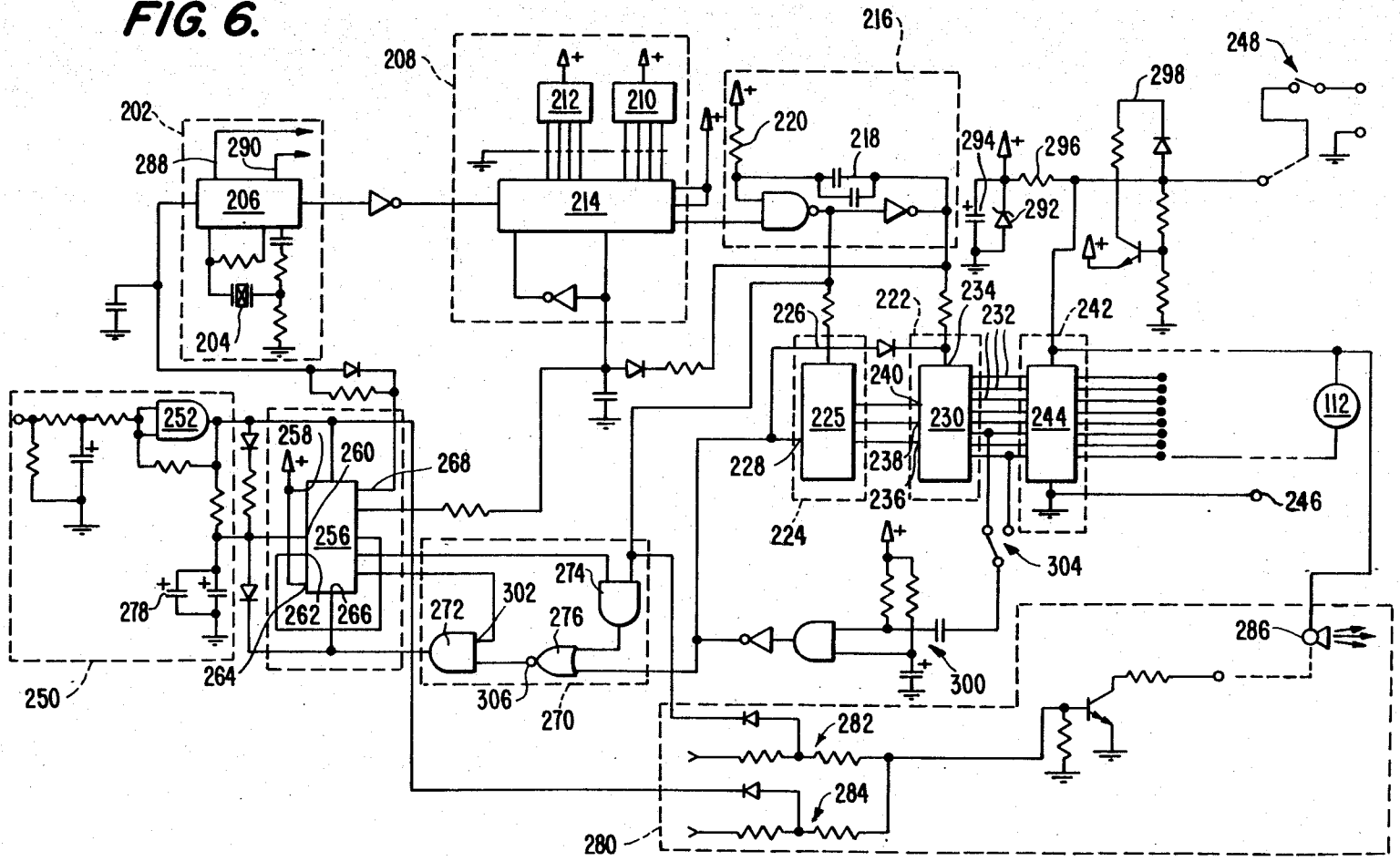
FIG. 6 is a schematic diagram showing the target launching control system of the present invention.

The frame 10 may also support housings for the components of the launcher electronic control system, such as is shown in FIG. 1. For example, housing 33 contains the main electronic control assembly, housing 35 contains a remote control receiver, and housing 51 contains the main power supply 248 (FIGS. 5 and 6).

When provided with six to eight throwing arms, a target launcher constructed according to the present invention weighs approximately 200 pounds and is, therefore, sufficiently portable to be transported to a suitable practice site. To enhance this portability, the frame or frame brace may be provided with several handles or similar hand grips 50, which may be located as shown in FIG. 1 or in any convenient position. Corresponding handles (not shown) should be located on the opposite side of the frame to facilitate lifting of the launcher. In addition, the frame and frame brace base members may be adapted to allow the attachment of removable wheels or casters (not shown), which will further enhance the ease with which the launcher may be moved.

The structural components of the frame and the frame brace can be joined together in the described configuration by welding, brazing or the like to form a strong, stable integral support structure which is capable of remaining stable when subjected to the forces exerted on it by the sequential action of the multiple throwing arm assemblies.

Approximate frame and frame brace dimensions which have been found to be suitable for a target launcher constructed in accordance with the present invention having six throwing arms are as follows: The frame base members, vertical side members and top members should preferably all be equal to about 30 inches in length, with the exception of base member 22, which may be longer, about 33 inches in length. The length of frame brace base members 40 and 44 should preferably be about 18 inches, so that the overall front to back distance of the launcher, including the width of base members 22 and 42 is about 50 to 51 inches. The length of frame brace side members 46 and 48 should preferably be about 32 inches, and the length of the throwing arm supports should preferably be about 45 inches to provide the required support and stability for six throwing arms. The foregoing dimensions are meant to be illustrative only, and to demonstrate that a six arm target launcher of a relatively compact size can be constructed in accordance with the present invention. The addition or deletion of throwing arms will, at a minimum, result in corresponding changes in the lengths of frame member base elements 18 and 22 and frame brace base member 42, and could require other changes as well.

Figure 3:
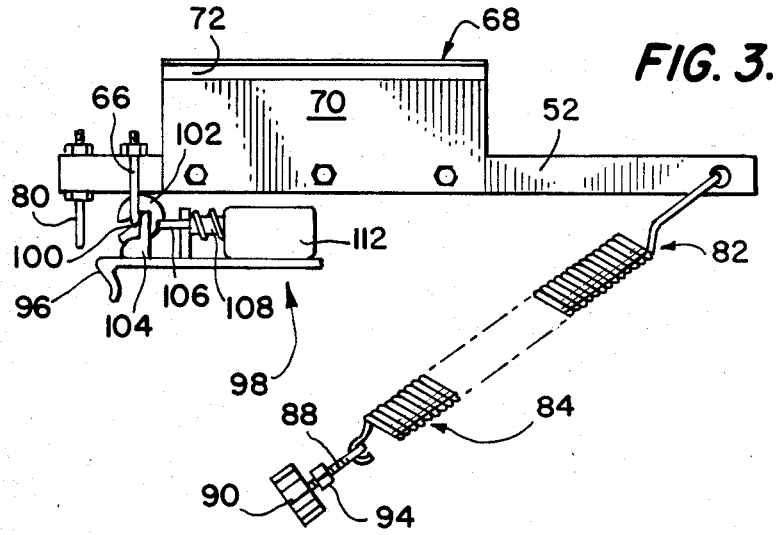
FIG. 3 is a diagrammatic representation of a single throwing arm constructed according to the present invention.

Six parallel throwing arms 52, 54, 56, 58, 60 and 62 are provided on the target launcher shown in FIG. 1; however, this number can be either increased or decreased. Each throwing arm, which is illustrated in more detail in FIG. 3, is rotatably mounted to pivot about a mounting rod 64 between a lock position and a release position. Only one terminal end of the mounting rod 64 can be seen in FIG. 1, which extends through the upper portions of throwing arm supports 37, 39, 41, 43, 45, 47 and 49 slightly above the plane of frame top elements 34 and 36. Each throwing arm is thereby rotatably mounted between two throwing arm supports. For example, arm 52 is mounted between supports 37 and 39, arm 54 is mounted between supports 39 and 41, and so forth. At the end of each throwing arm proximal to the mounting rod 64 a spring engaging means (not shown) is provided whereby a spring may be secured to this end of the throwing arm. At the opposite end of each mounting arm there is provided a striker 66 engaged in the lock position shown in FIG. 1 by a solenoid activated latch mechanism, which is illustrated in FIGS. 3, 4 and 5 and will be described in detail below. A target receptacle 68 is secured to the upper surface of each throwing arm and extends from the striker 66 toward the mounting rod 64 for a distance which is preferably equal to approximately one half of the length of the throwing arm.

Figure 2:
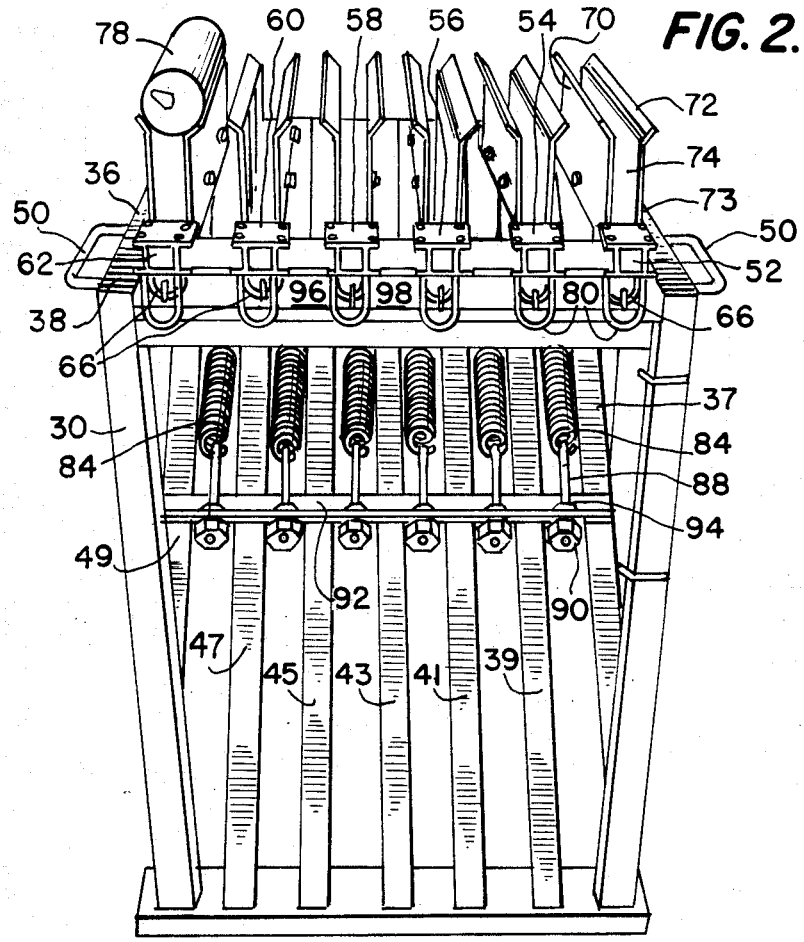
FIG. 2 is a front perspective view of the target launcher of FIG. 1 illustrating all throwing arms in the lock position.

The target receptacles have been designed to hold a variety of different targets. FIG. 2 clearly illustrates the target receptacle cross-sectional configuration which makes this possible. Each target receptacle 68 includes a pair of opposed vertical side walls 70 mounted directly on the throwing arm perpendicular to the arm. The upper edge of each side wall 70 terminates in a flanged lip portion 72, which is bent outwardly from the interior 74 of the target receptacle, preferably at an angle of approximately 45° from each vertical side wall 70. The height of the vertical side walls 70 can vary to accommodate different sizes of targets; however, a height of about 4 inches has been found to accommodate readily a number of different target types. Since the throwing arms are preferably constructed from square aluminum tubing approximately 1.25 inches on a side, the width of each target receptacle 68 will also be about 1.25 inches, except for the lip portion 72 which will, of course, be wider.

The targets most widely used by archers are "skidgeon", such as the targets 76 shown in FIG. 1. Skidgeon are typically formed from multiple layers of corrugated cardboard glued together to a thickness of about one inch and cut into circles having diameters. ranging from about 4 inches to about 12 inches in size. A special design, such as that shown in FIG. 1, may be painted on one side and a standard concentric ring "bulls-eye" target on the other. The target launcher of the present invention is especially well suited for throwing this type of target to provide archers with a sustained wing shooting target practice session. The flanged lip portion 72 at the top of each target receptacle 68 will easily support one or more beverage cans 78 which also can be thrown as described herein to provide moving target practice for gun and archery enthusiasts. Even "clay pigeons" or skeet can be held by the target receptacle 68. The present target launcher, with or without minor modifications, may also be employed to throw other kinds of targets than those shown and described. Moreover, each target receptacle 68 is capable of being loaded with one or more different kinds of targets or with one or more of the same kind of target. It is, therefore, possible to throw skidgeon, beverage cans and skeet simultaneously with the present target launcher.

For convenience, each throwing arm may be provided with an eye 80 which is engaged by a hook (not shown) on a manual cocking means (not shown) which may be employed to return each throwing arm to the lock position, thereby engaging the striker 66 in the latch mechanism (FIGS. 3, 4, and 5).

Each throwing arm is further connected to one end 82 of an adjustable spring 84 at the end of the throwing arm proximal to the mounting rod 64 by conventional spring engaging means (not shown). The opposite end 86 of the spring 84 is attached to a threaded shaft 88 which extends through an origin plate 92 to terminate in an adjustment knob 90. The origin plate 92 is mounted across most of the width of the frame 12 and is secured to each throwing arm support. A nut 94, which is on the opposite side of the origin plate 92 from the adjustment knob 90, is threaded on shaft 80 to assist in maintaining the spring 84 under the tension selected. The tension on spring 84 can be adjusted simply by turning the adjustment knob 90 in the proper direction either to increase or decrease the spring tension. The spring 84 is held in a stretched condition when the throwing arm is in the lock position and in a relaxed condition when the throwing arm is in the release position. The tension placed on spring 84 directly affects both the velocity with which a target is thrown and its trajectory. The greater the force exerted by the spring on the throwing arm is, the faster the velocity of the target and the higher from the ground its flight path will be.

FIG. 1 illustrates the relative positions of throwing arm 62 in the lock position, following release from the lock position, and in the release position. The target 76 will be released from the target receptacle 68 of throwing arm 62 to follow a trajectory substantially like that defined by arrow 96 following the release of throwing arm 62 from the lock position. Once a throwing arm is in the release position, it must be returned to the lock position manually. Cocking means (not shown) including a hook to engage eye 80 on the end of the throwing may be used as discussed above. However, any convenient method or apparatus for rotating the throwing arm from the release to the lock position may be employed.

The striker 66, target receptacle 68, springs 84 and related structures have all been described with respect to a single throwing arm. However, these structures will be substantially identical for each of the throwing arms 52, 54, 56, 58, 60 and 62.

FIG. 2 illustrates the target launcher of FIG. 1 in front perspective view, showing the cross-sectional configuration of the target receptacles and the positions of the throwing arms 52, 54, 56, 58, 60 and 62 relative to throwing arm supports 37, 39, 41, 43, 45, 47 and 49. The attachment of the springs 84 to the origin plate 92, and the location of the origin plate 92 relative to the throwing arm supports 37, 39, 41, 43, 45, 47 and 49 can also be clearly seen in this view.

FIG. 2 illustrates further the structures secured to the frame 12 which support the latch mechanisms and solenoids associated with each throwing arm. Shelf 38, discussed in connection with FIG. 1, extends across the top of the frame from top member 34 to top member 36 to cover a bracket 96 on which is mounted a latch and solenoid assembly 98 to correspond to each throwing arm.

FIG. 3 shows diagrammatically a single throwing arm 52 and its relationship to the spring 84 and the latch and solenoid assembly 98. When arm 52 is in the lock position shown, striker 66 is engaged in a notch 100 in a rotating cam 102. The cam 102 is rotatably mounted on bracket 96 between a pair of cam supports 104, only one of which is shown, which are, in turn, mounted on bracket 96. A pivoting cam release 106 is mounted on bracket 96 substantially perpendicularly to the vertical axis of cam supports 104 and substantially parallel to bracket 96 to engage a catch 107 (FIG. 5) on the cam 102. A solenoid rod 108 including a compression spring 110 is positioned to contact or release pivoting cam release 106 in response to the actuation of a solenoid 112.

FIG. 4 and 5 demonstrate the latch and solenoid assembly 98 in greater detail. FIG. 4 illustrates this assembly as it would appear viewed from the top of the launcher looking downward to the base. The pivoting cam release is rotatably mounted on a support shaft 114 so that it moves in a plane substantially parallel to the plane of bracket 96 and is maintained in spaced relationship thereto. The pivoting cam release preferably has the configuration shown in FIG. 4; however, any configuration which achieves the same function may also be employed. A lip 116 formed in the perimeter of the pivoting cam release as shown engages catch 107 on the cam 102 as shown to maintain the striker 66 in notch 100 and, thus, to hold the throwing arm in the lock position. When the solenoid is de-energized as shown in FIG. 4, the compression spring 110 on the solenoid arm 108 holds the pivoting cam release in this position. When the solenoid is energized, the spring 110 is compressed, allowing cam release 106 to move in the direction shown by arrow 118 to allow rotation of the cam 102 in the direction of arrow 120 in FIG. 5. This rotation of cam 102 results in the release of striker 66 from the notch 100, where it has been held under tension to maintain the throwing arm in a lock position. The release of the striker from the cam 102 results in the movement of the throwing arm to the release position as the tensioned spring 84 relaxes. As explained hereinabove, during the travel of the throwing arm from the lock to the release position any targets loaded in the target receptacle 68 will be thrown. The return of the striker to cam notch 110 will cause the cam 102 to rotate until the pivoting cam release 106 is pushed toward the cam by the compression spring 110 so that lip 16 engages cam notch 107, thereby locking the striker 66 in cam notch 100 and the throwing arm in the lock position. Re-energization of the solenoid 112 will re-active the entire cycle to release the throwing arm again. Each throwing arm 52, 54, 56, 58, 60 and 62 has associated with it a substantially identical latch and solenoid assembly.

The energization of each throwing arm solenoid and resulting release of the throwing arm is controlled by a battery powered electronic control system which is shown in block diagram in FIG. 5. FIG. 6 illustrates, in addition, a schematic diagram of the circuitry of the control system of the present invention. The circuit is activated upon receipt of a single input from the shooter, which may be by cable or radio transmitter (not shown) to start the control timing system. An audible signal is emitted by the control system upon receipt of the input to alert the shooter that the timer has been started. The input signal will then activate one of two modes of operation, depending upon the number of times the input signal is pulsed. A single activation will release only a single throwing arm after a time interval which has been preset as described below. However, if the input is pulsed twice rapidly, a multi-mode operation is activated which results in the sequential release of each throwing arm at a present, timed interval. The present control system permits the multi-mode operational sequence to be stopped with a subsequent input pulse so that the system is immediately available for the next operation.

FIG. 5 illustrates the major components of the throwing arm control assembly 200. The timing which triggers each solenoid is provided by a time base generator 202. The time base generator includes an accurate quartz crystal 204, such as the Series Mode available from Statek Corporation. The crystal oscillates at 16.384 kiloherz (16384 cycles per second), and is divided down to a one second clock with a 14 stage binary divider circuit 206, such as a complimentary metal oxide semiconductor 14 stage binary counter available from Motorola, RCA and others.

The counter 208 includes a pair of switches and a decimal counter. The timing intervals can be selected with two decimal rotary switches 210, 212 which set the units and tens of seconds, respectively, of the interval desired between the release of each shooting arm. These rotary switches may be present manually by the shooter prior to activation of the control assembly to enable a throwing arm release interval between 1 and 99 seconds. The switch settings are loaded into an 8 bit decimal counter circuit 214, such as a complimentary metal oxide semiconductor 8 bit decimal counter available from RCA, when the control assembly is a reset condition and whenever a solenoid is activated. With each clock pulse received by the decimal counter 214 the number loaded into the counter is decremented by a value of one. Since the clock is a very accurate one second clock, the numbers loaded into the decimal counter 214 are in seconds. The initiation of the driving of a solenoid occurs when the number originally loaded into the clock has been decremented to zero.

When the counter 208 detects zero, the pulse shaper 216 is triggered. This circuit is essentially a simple monostable timer which, when triggered, charges a 0.2 microfarad capacitor 218 through a 1.5 megohm resistor 220 so that the circuit is charging for the duration of the RC time constant. While the pulse shaper 216 is charging, a low signal is sent to a decoder circuit 222 to enable one of its outputs as will be explained below. When the pulse shaper stretch time has elapsed, the decoder circuit 222 is disabled, and a low signal is sent to the sequencer circuit 224, which steps it to the next solenoid position.

The sequencer 224 includes a 7 stage binary counter integrated circuit 225 capable of producing a 3 bit binary code representing the number of clock pulses received at pin 226. Since the sequencer counts only the low signals at this input, the clock input from the counter must cycle completely from low to high and back to low to complete a count. A reset input at pin 228 forces the sequencer to a count zero position when a true signal equal to about 5 volts is received.

The decoder 222 includes a decimal decoder 230 of the complimentary metal oxide semiconductor type manufactured by National Semiconductor and others. This circuit is a 3 line to 8 line decoding device which reads the 3 bit binary code generated by the sequencer and decodes it into one of eight output lines 232. The decoder 230 includes an input 234 which may be used as an enable which functions to hold the 8 outputs 232 at zero when a 1 is present at this input. When input 234, which is also designated as "D", goes low, the 3 bit code at decoder inputs 236, 238 and 240 will be decoded at one of the outputs as a logic 1.

The driver 242 includes a Darlington transistor array 244 consisting of eight Darlington transistors with eight suppression diodes, such as the Octal Darlington Transistor Array manufactured by Motorola and Sprague. The suppression diodes are required to clamp the counter-electromotive force produced by the solenoids when their magnetic fields collapse, thereby preventing destruction of the transistors. The placement of a logic 1 on a driver input will activate its respective transistor to provide a ground 246 to that particular solenoid circuit. On the other side the solenoid 112 is connected to a power supply 248 of more than 12 volts; consequently, a ground from the driver 242 will energize that solenoid 112.

A type of solenoid preferred for use with the present invention is a 12 volt, 20 watt pull type solenoid available from Deltrol or Endicott Coil. However, similar solenoids available from other manufacturers might also be used.

The trigger input 250 includes a timed Schmitt trigger 252 to filter out any bounce of switch contacts. The trigger input requires an input to dwell in a defined state, e.g., on or off, for a minimum period of about 50 milliseconds (0.05 seconds) before it is recognized and a trigger acknowledged. A positive voltage of greater than 6 volts must be applied to the input for more than 50 milliseconds before a trigger is acknowledged. When a trigger is acknowledged, the first stage in the trigger memory 254 is set. The trigger memory 254 includes a 4 bit latch, such as a CMOS (complimentary metal oxide semiconductor) Quad Latch 256 supplied by Motorola, RCA and others. This 4 bit latch includes an edge triggered clock with true and complement outputs for each of the four inputs 258, 260, 262 and 264. The trigger memory includes an active low reset input 266, which can be used to force all four stages to a false state. The latch 256 is updated by a clock signal produced with the input signal which clocks in the state of the inputs received by the trigger memory where they are retained and presented at their respective outputs.

The trigger memory 254 only requires three of the four memory stages provided by the latch 256. The first stage of the trigger memory is preferably fixed at a true level so that any input signal transfers this level to the stage 1 output 268 which activates the time base generator 202. A second input timer, which is started with each input signal, is monitored by the second stage. Following the first input, a cycle of the input, e.g., off, then on, within a two second time period causes stage two of the trigger memory 254 to be set true, thereby activating the control assembly multi-mode status. The activation of multi-mode status prevents automatic reset from the next solenoid driver in sequence while simultaneously preparing the third stage with a true signal. In the presence of a third input signal, the true signal is transferred through stage 3, thus inhibiting further operation with immediate reset gating.

The mode gate 270 will be activated if the second stage of the trigger memory 254 was set for multi-mode to allow the sequential release of all of the throwing arms. The mode gate includes and gates 272 and 274 and a nor gate 276. If multi-mode was not set, and gate 274 sends a true signal to the nor gate 276, which then sends a false signal to and gate 272, placing a low signal at reset input 266 of latch 256. The receipt of such a low signal will additionally cause a second input timer 278 to time out, which allows the entire input sequence to be restarted. However, if multi-mode was set, a false signal is provided to and gate 274, which prevents resetting of the sequence.

As described hereinabove, the present invention employs an audible signal both to indicate that the control assembly has been activated and to signal the release of each throwing arm. These signals differ in frequency, with a low-frequency tone being emitted upon reception of a control assembly initiating input and a high-frequency tone being emitted upon the release of a throwing arm. The control assembly, therefore, includes a speaker circuit 280 which is activated by appropriate signals from the trigger input 250 and mode gate 270. The speaker circuit includes a low frequency gate 282 and a high frequency gate 284. The tones for the speaker 286 are provided by signals from the binary divider circuit 206. The high frequency tone, which oscillates at 1024 Hz, is driven by signal 288 from circuit 206, and the low frequency tone, which oscillates at 512 Hz, is driven by signal 290 from circuit 206.

The power supply used for the present target launcher is a standard 12 volt plus power supply, which may be provided by any one of a number of currently available batteries, such as a dry cell, lead acid or nickel-cadmium battery. Automobile batteries are especially well-suited to power the present invention. It has, in addition, been found convenient to provide a power supply adapter (not shown) which may be plugged into a conventional automobile cigarette lighter socket to provide an additional source of power in remote locations. The control logic of control assembly 200 is powered by a nominal 5.6 volt regulated and filtered power supply derived from a 5.6 volt Zener diode 292 and a 1.0 microfarad capacitor 294 following a voltage reduction from the 12 volt main power supply 248 through a 1.0 kilohm resistor 296.

The main power supply 248 may be provided with a battery function detector 298 (FIG. 6), which preferably includes indicia in the form of an LED display to indicate battery strength.

When the power supply to the target launcher is turned on, a power-on reset detector 300 provides at least one second of initialization signal, which forces the sequencer 224 to state zero, locks out the decoder 222 to prevent the activation of any of the drivers 242, and resets the trigger memory 254 to a non-operating condition. The main time based generator 202 is held in a reset condition while the counter 208 reads the rotary switches 210, 212. If there has been any change in the rotary switches, this will be acknowledged immediately by the counter 208, and the switch positions present when an input trigger signal is initiated will be the timing used for the first solenoid.

The acknowledgement of a trigger sets the first stage in trigger memory 254, which then removes the reset from the main time base 202, tells counter 108 to use the present settings of switches 210, 212, enables the high frequency speaker driver 284 and starts the second input timer 278. While the main time base is running, a high pitched sound is emitted from the speaker for the duration of the input trigger signal. The one second clock described above is now being produced for the counter 208, and the second input timer 278 permits the occurrence of another trigger input within two seconds. The occurrence of a second trigger within this two second period will set the second stage of trigger memory 254 to enable the multi-mode operation of the control assembly 200. The failure of a second trigger to occur within this two second period will result in the sequence being stopped until another trigger signal is received. If multi-mode has been enabled, a third trigger input will simulate a power-on reset condition, with the exception that the sequencer 224 will remain at the next output instead of returning to the first output.

As explained above, the pulse shaper 216 catches the timed out output of the counter 208 and then stretches a pulse for about 200 milliseconds to enable the decoder 222, which will send only one of eight possible signals to the driver 242, depending which of the eight signals comes next in the sequence. The low frequency driver 282 is also simultaneously enabled. Additionally, during this time, the counter 208 is told to read the switches 210, 212 to determine whether a new number has been set to be used in setting the counter for the next solenoid. Following the 200 millisecond pulse stretching interval, the decoder 222 is disabled, and the sequencer 224 is stepped to the next solenoid position to await an enable signal. The same signal from the pulse shaper 216 which steps the sequencer 224 and enables the low frequency speaker output also enables and gate 274 to ascertain whether the second stage of the trigger memory 254 was set for multi-mode. The circuit operation resulting from this determination has been discussed above in connection with mode gate 270.

If multi-mode has been selected, the control assembly may be reset by two methods. The first method utilizes the fact that and gate 272 has a constant true (5 volts) signal at pin 302, which is the inverted state of stage 3 from the trigger memory 254. Upon reaching stage 3 or the third input signal, pin 302 of and gate 272 goes false (0 volts), which provides a reset action as described above. The second method of accomplishing reset utilizes the decoder 222, wherein the last drive is connected to a "stop select" circuit 304, which uses the trailing edge of the selected drive signal to duplicate completely a "power-on reset" condition. When the selected drive signal goes from true to false, the signal is sent through the power-on reset circuit 300 to provide a true signal to reset the sequencer 224, to remove any enable from the decoder 222 and to provide a false signal to pin 306 of nor gate 276. The result is the reset action already described. It is, therefore, possible to interrupt the sequence of timed intervals for activating the throwing arms at more than one point after the intervals have been set and the control assembly 200 has been activated.

The target shooter using the described control assembly can activate a single throwing arm or activate the sequential release of all of the throwing arms (multi-mode) with a conventional radio transmitter or remote control device, thus enabling him or her to assume a shooting position at a convenient distance from the launcher. The launcher may also be activated manually, if desired, through an input switch (not shown) on the frame.

The multiple arm target launcher of the present invention has been described with respect to six and eight throwing arms; however, these members are not intended to be limiting, but are intended merely as illustrative of how six throwing arms would be arranged and supported in accordance with the present invention and how eight throwing arms would be automatically activated and driven to throw targets. However, any number of throwing arm latch and solenoid assemblies could be driven by making appropriate modifications to the control assembly 200, and such modifications are contemplated to be within the scope of the present invention.

INDUSTRIAL APPLICABILITY

The target launcher of the present invention will find its primary application to provide target practice for shooting enthusiasts, in particular archers, who need to practice shooting at targets which move at different speeds and in varying flight paths. This target launcher can be readily used by one or more persons to provide the controlled, automatic release of a plurality of targets at timed intervals required for a sustained target practice session. The present target launcher may, moreover, be adapted to form a stationary structure including a large number of throwing arms supported and driven as described herein. The multiple arm target launcher shown and described herein may also be adapted for throwing targets such as skeet horizontally with respect to the ground simply by turning the launcher on one side so that the throwing arms pivot in a plane substantially parallel to the ground. Other improvements and modifications within the scope of the present invention will be apparent to those skilled in the art.

We claim:

1. A target launcher for launching sequentially a plurality of targets at predetermined timed intervals comprising (a) frame means for supporting thereon at least two spaced parallel longitudinal target throwing means for launching targets;

(b) pivot mount means on said frame means for rotatably mounting said target throwing means to pivot between a lock position wherein said target throwing means is secured to said frame means and a throwing position wherein said target throwing means is rotated about said pivot mount means;

(c) adjustable spring means extending between said target throwing means and said frame means for driving said target throwing means between the lock position and the throwing position;

(d) latch means mounted on said frame means for engaging striker means located on the end of said throwing arm means opposite said spring means to hold said target throwing means in a lock position;

(e) target receptacle means on said throwing arm means for holding targets to be thrown; and (f) control assembly means for automatically opening said latch means to release sequentially at timed intervals each said throwing arm from said lock position to said throwing position.

2. A target launcher as described in claim 1, wherein said frame means includes base means substantially parallel to the ground for locating said frame means on the ground in an outdoor location, said throwing arms are mounted in a plane substantially parallel to said base means, and said throwing arms pivot through a plane substantially perpendicular to said base means.

3. A target launcher as described in claim 2, wherein said frame means includes frame brace means for stabilizing said frame means while said spring bias means are driving each throwing arm from a lock to a throwing position.

4. A target launcher as described in claim 3, wherein said frame means further includes a plurality of spaced longitudinal throwing arm support means positioned to extend angularly from said base means to said pivot mount means, said target throwing means being mounted on said frame means alternately with said throwing arm support means so that each target throwing means is located between a throwing arm support means.

5. A target launcher as described in claim 4, wherein said throwing arm support means includes mounted thereon spring mounting means for adjustably securing said adjustable spring means.

6. A target launcher as described in claim 5, wherein a spring means is associated with each said target throwing means so that said target throwing means engages one end of said spring means and the opposite end of said spring means is adjustably mounted to said spring mounting means.

7. A target launcher as described in claim 6, wherein said frame means has a substantially cubic configuration with said base means forming the base of said cube, said target throwing means is positioned to occupy a plane substantially parallel to and immediately above the top of said cube, and said throwing arm support means extends diagonally from the top to the base of said frame means to bisect said cube into two substantially triangular portions.

8. A target launcher as described in claim 2, wherein each said throwing arm means includes a first surface which is oriented toward the ground and a second surface which is oriented away from the ground and said striker means is located on said first surface and said target receptacle means is located on said second surface.

9. A target launcher as described in claim 8, wherein said target receptacle means is coextensive with approximately one half of the longitudinal extent of said throwing arm and includes at least two vertical side walls spaced to define an interior receptacle, said vertical walls further including an outwardly flanged lip for supporting targets on said second surface.

10. A target launcher as described in claim 1, wherein said latch means includes associated therewith solenoid means for activating said latch means to release the striker means of said throwing arm, thereby releasing said throwing arm from a lock position.

11. A target launcher as described in claim 10, wherein said latch means includes rotatably mounted cam means for receiving directly the latch engaging means of said throwing arm, cam release means rotatably mounted perpendicularly to said cam means for holding said cam means in engagement with said striker means and spring means biased toward said cam release means to hold said cam release means against said cam means when said solenoid means is in a de-energized condition.

12. A target launcher as described in claim 11, wherein said control assembly means is drivingly connected to said solenoid means to energize said solenoid means when said control assembly means is activated.

13. A target launcher as described in claim 12, wherein each of said throwing arms includes striker means releasably engaged by a corresponding latch means mounted on said frame means.

* * * * *